US009434887B2

(12) United States Patent
Kift et al.

(10) Patent No.: US 9,434,887 B2
(45) Date of Patent: Sep. 6, 2016

(54) APPARATUS AND METHOD FOR EXTRACTION OF BITUMEN FROM OIL SANDS

(71) Applicants: Shell Canada Energy, Calgary (CA); Chevron Canada Limited, Calgary (CA); Marathon Oil Sands L.P., Calgary (CA)

(72) Inventors: Julian Robert Kift, Reno, NV (US); Whip Clinton Galen Thompson, St. Sparks, NV (US); Ingmar Hubertus Josephina Ploemen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 352 days.

(21) Appl. No.: 13/943,568

(22) Filed: Jul. 16, 2013

(65) Prior Publication Data

US 2014/0021102 A1 Jan. 23, 2014

(30) Foreign Application Priority Data

Jul. 17, 2012 (CA) ..... 2783284

(51) Int. Cl.
*C10G 1/04* (2006.01)

(52) U.S. Cl.
CPC ..... *C10G 1/04* (2013.01); *C10G 1/045* (2013.01)

(58) Field of Classification Search
CPC ..... C10G 1/04; C10G 1/045
See application file for complete search history.

(56) References Cited

U.S. PATENT DOCUMENTS

| | | | | |
|---|---|---|---|---|
| 4,306,961 | A * | 12/1981 | Taciuk | B01J 8/10 208/390 |
| 4,719,008 | A * | 1/1988 | Sparks et al. | 208/390 |
| 5,534,136 | A * | 7/1996 | Rosenbloom | 208/390 |
| 2012/0152809 | A1 * | 6/2012 | Kift | C10G 1/04 208/390 |

* cited by examiner

*Primary Examiner* — Renee E Robinson

(57) ABSTRACT

The present invention provides an apparatus, at least comprising:

a housing containing a first section, a second section and a third section;

the first section having a first inlet for oil sand, a second inlet for solvent and an outlet for solvent-diluted oil sand slurry;

the second section having an inlet for the solvent-diluted oil sand slurry, a screen allowing undersized material to pass and an outlet for oversized material; and the third section having an inlet for oversized material and an outlet for solvent-depleted oversized material;

wherein the first section, the second section and the third section can rotate during use around a common rotation axis (A-A').

9 Claims, 2 Drawing Sheets

APPARATUS AND METHOD FOR EXTRACTION OF BITUMEN FROM OIL SANDS

RELATED APPLICATIONS

This application claims the benefit of Canadian Application No. 2,783,284 filed Jul. 17, 2012, which is incorporated herein by reference.

BACKGROUND

The present invention relates to an apparatus, in particular to an apparatus for removing "rejects" that is of use in a method for extracting bitumen from an oil sand stream. Further, the present invention relates to a method for extracting bitumen from an oil sand stream whilst using the apparatus.

Various methods have been proposed in the past for the recovery of bitumen (sometimes referred to as "tar" or "bituminous material") from oil sands as found in various locations throughout the world and in particular in Canada such as in the Athabasca district in Alberta and in the United States such as in the Utah oil sands. Typically, oil sand (also known as "bituminous sand" or "tar sand") comprises a mixture of bitumen (in this context also known as "crude bitumen", a semi-solid form of crude oil; also known as "extremely heavy crude oil"), sand, clay minerals and water. Usually, oil sand contains about 5 to 25 wt. % bitumen (as meant according to the present invention), about 1 to 13 wt. % water, the remainder being sand and clay particles.

As an example, it has been proposed and practiced at commercial scale to recover the bitumen content from the oil sand by mixing the oil sand with water and separating the sand from the aqueous phase of the slurry formed.

Other methods have proposed non-aqueous extraction processes to reduce the need for large quantities of process water.

A problem of known methods of extraction of bitumen from oil sand is the handling of the rejects, i.e. the relatively large lumps such as stone and clay that remain intact after the oil sand stream has been contacted with solvent.

It is an object of the present invention to improve the handling of such rejects.

It is a further object of the present invention to provide a more efficient handling of rejects in an oil sand stream, in particular when bitumen is to be extracted from the oil sand stream using a non-aqueous solvent, which non-aqueous solvent needs to be removed from the rejects prior to disposal.

SUMMARY OF THE INVENTION

One or more of the above or other objects may be achieved according to the present invention by providing an apparatus, at least comprising:

- a housing containing a first section, a second section and a third section;
- the first section having a first inlet for oil sand, a second inlet for solvent and an outlet for solvent-diluted oil sand slurry;
- the second section having an inlet for the solvent-diluted oil sand slurry, a screen allowing undersized material to pass and an outlet for oversized material; and
- the third section having an inlet for oversized material and an outlet for solvent-depleted oversized material;

wherein the first section, the second section and the third section can rotate during use around a common rotation axis.

It has now been found that the apparatus according to the present invention provides a surprisingly simple and elegant manner to remove rejects, in particular from an oil sand stream.

An important advantage of the present invention is that it allows a reduction in overall height requirement, and, in some embodiments, a reduction in the number of rotary seals and a reduction in the number of drive assemblies, when compared to performing the mixing, screening and drying/solvent removal operations in separate devices.

A further advantage according to the present invention is that coarse solids as present in the oil sand do not require to be transported between separate devices for mixing, screening and drying/solvent removal. The handling of such coarse solids is already a challenge in conventional oil sand processes, but much more difficult in case a non-aqueous solvent (which typically comprises a volatile hydrocarbon) is to be used for extracting bitumen from the oil sand.

The housing and first, second and third sections as used in the apparatus according to the present invention are not limited in any way. The housing typically surrounds the first, second and third sections and ensures that no undesired leakage of vapours to the environment occurs; this is of particular relevance if a non-aqueous solvent is used in the first section. The housing may be formed by the outer walls of the first, second and third sections and hence does not need to be a separate element. Preferably, the first inlet of the first section, the inlet of the second section and the inlet of the third section are axial inlets; also it is preferred that the outlet of the first section, the outlet of the second section and the outlet of the third sections are axial outlets. It goes without saying that further inlets and outlets may be present (which may be axial or not).

During use, in the first section, oil sand is contacted with solvent, preferably a non-aqueous solvent (and typically, if the solvent is recycled from a downstream point of the process with some dissolved bitumen as well). In the second section, the solvent-diluted oil sand slurry is screened to allow undersized material to pass. In the third section solvent is removed from the oversized material thereby obtaining solvent-depleted oversized material; this solvent-depleted oversized material ("rejects") is typically discharged for disposal after the solvent has been removed. Care is taken that substantially no solvent vapour escapes from the contained processing environment in the housing and hence also no solvent vapour escapes with the solvent-depleted oversized material, e.g. using a lock hopper device, a rotary star valve or further alternatives.

The first section, the second section and the third section can rotate during use around a common rotation axis. Typically, the first, second and third sections can co-rotate around the common rotation axis as one single rotation assembly (i.e. in the same direction and at the same speed).

The progression of the oil sand, slurry and other solids containing streams through the apparatus may be aided by inclining the first, second and third sections a few degrees from horizontal (wherein the first section is at a higher point than the second section, and the second section at a higher point than the third section), e.g. as done in a calcining kiln. In addition or alternatively, lifters and/or flutes may be placed in such a way to mechanically aid the progression of the solid containing streams or retain it in one area for a longer time. The use of lifters also aids in the agitation and contact of bitumen and solvent in the first section and hence accelerates the bitumen dissolution process, although agitation should not be so great as to break up significant clay lumps which can hinder downstream processing.

Preferably, the screen of the second section and the housing define an annular pathway arranged around the screen for removing the undersized material passed through the screen. As mentioned above, the housing may be formed by the outer walls of the first, second and third sections and does not need to be a separate element. In the case wherein the screen of the second section and the housing define an annular pathway arranged around the screen, the outer wall of the second section and the housing may coincide. Preferably, the annular pathway at least partially surrounds the third section; in this case the wall of the housing does not coincide with the outer wall of the third section but is a separate element. Further it is preferred that the annular pathway is fluidly connected to an inlet of a filtration unit. Preferably, the undersized material removed via the annular pathway is thickened (i.e. made denser) prior to feeding to the filtration unit. To that end, the apparatus preferably comprises a thickener between the annular pathway and the inlet of the filtration unit, typically in the form of a hydrocyclone or the like.

It is preferred that the apparatus comprises an outlet for solvent vapour. Preferably, the outlet for solvent vapour is connected to an inlet of a solvent recovery unit. The outlet for solvent may be located at various places, but is preferably located in the first section.

Furthermore, it is preferred that the third section comprises an inlet for a purge gas, such as $N_2$ or steam, or a combination thereof.

In a further aspect the present invention provides a method for extracting bitumen from an oil sand stream using the apparatus according to the present invention, the method comprising at least the steps of:

(a) providing an oil sand stream;

(b) contacting the oil sand stream with a solvent in the first section thereby obtaining a solvent-diluted oil sand slurry;

(c) screening the solvent-diluted oil sand slurry in the second section, thereby obtaining oversized material and undersized material;

(d) removing solvent from the oversized material in the third section thereby obtaining solvent-depleted oversized material;

(e) filtering the undersized material obtained in step (c), thereby obtaining a solids-depleted stream and a solids-enriched stream;

(f) optionally removing solvent from the solids-depleted stream obtained in step (e) thereby obtaining a bitumen-enriched stream;

wherein the first section, the second section and the third section rotate around a common rotation axis.

According to the present invention, the providing of the oil sand stream in step (a) can be done in various ways. Typically, oil sand is reduced in size, e.g. by crushing, breaking and/or grinding, to below a desired size upper limit. Preferably, the oil sand provided in step (a) has a particle size of less than 20 inch, preferably less than 16 inch, more preferably less than 12 inch. Also, the oil sand stream provided in step (a) is typically subjected to a deoxygenation step; this is of particular relevance if the solvent as used in step (b) is a flammable solvent.

In step (b), the oil sand is contacted with a solvent in the first section thereby obtaining a solvent-diluted oil sand slurry. The person skilled in the art will understand that, in particular when the solvent is recycled from a downstream point in the process, it may be mixed with some bitumen.

The solvent as used in the method of the present invention may be selected from a wide variety of solvents, including water, aromatic hydrocarbon solvents and saturated or unsaturated aliphatic (i.e. non-aromatic) hydrocarbon solvents; aliphatic hydrocarbon solvents may include linear, branched or cyclic alkanes and alkenes and mixtures thereof. Preferably, the solvent in step (b) comprises a non-aqueous solvent. Preferably, the solvent in step (b) comprises an aliphatic hydrocarbon having from 3 to 9 carbon atoms per molecule, more preferably from 4 to 7 carbons per molecule, or a combination thereof. Especially suitable solvents are saturated aliphatic hydrocarbons such as propane, butane, pentane, hexane, heptane, octane and nonane (including isomers thereof), in particular butane, pentane, hexane and heptane. It is preferred that the solvent in step (b) comprises at least 90 wt. % of the aliphatic hydrocarbon having from 3 to 9 carbon atoms per molecule, preferably at least 95 wt. %. Also, it is preferred that in step (b) substantially no aromatic solvent (such as toluene or benzene) is present, i.e. less than 5 wt. %, preferably less than 1 wt. %. Further it is preferred that a single solvent is used as this avoids the need for a distillation unit or the like to separate solvents. Also, it is preferred that the solvent has a boiling point lower than that of the bitumen to facilitate easy separation and recovery.

Furthermore, if desired, additional process fluids may be added, such as water and/or agglomeration agents, for example to aid in achieving desired slurry properties through agglomeration of fine particles.

In step (c), the solvent-diluted oil sand slurry is screened in the second section, thereby obtaining oversized material and undersized material. Typically, the solvent-diluted oil sand slurry screened or reduced in size to have a diameter below 5.0 cm, preferably below 2.0 cm, more preferably below 1.0 cm. If the screening is performed in the presence of non-aqueous solvent, this helps breaking down the larger (bitumen-containing) lumps and dissolving the bitumen.

In step (d), solvent is removed from the oversized material in the third section thereby obtaining solvent-depleted oversized material (the "rejects"). Although the removal of solvent may be performed in various ways, it usually includes heating and preferably the use of a purge gas, such as $N_2$ or steam. Heating may be achieved e.g. through heating of the outer wall of the third section or by introducing a heated stripping gas (which may be $N_2$ or steam, or the like). Preferably the purge gas (and/or stripping gas) is fed in such a way that it flows counter-currently to the direction of the solids stream. In this way, solvent removed from the rejects is carried back into and may (partly) condense in the first and second sections.

In step (e), the undersized material obtained in step (c) is filtered, thereby obtaining a solids-depleted stream and a solids-enriched stream. Again, this filtration step is not limited in any way. As the person skilled in the art is familiar with how to perform such a filtration step, this is not further discussed here in detail.

In step (f), optionally solvent is removed from the solids-depleted stream obtained in step (e) thereby obtaining a bitumen-enriched stream. This bitumen-enriched stream may be sent to a refinery or the like for further upgrading. As the person skilled in the art is familiar with how to remove the solvent and upgrade the bitumen-enriched stream, this is not further discussed here in detail.

BRIEF DESCRIPTION OF THE DRAWINGS

Hereinafter the invention will be further illustrated by the following non-limiting drawings. Herein shows.

DETAILED DESCRIPTION

For the purpose of this description, a single reference number will be assigned to a line as well as a stream carried in that line.

Figure 1:
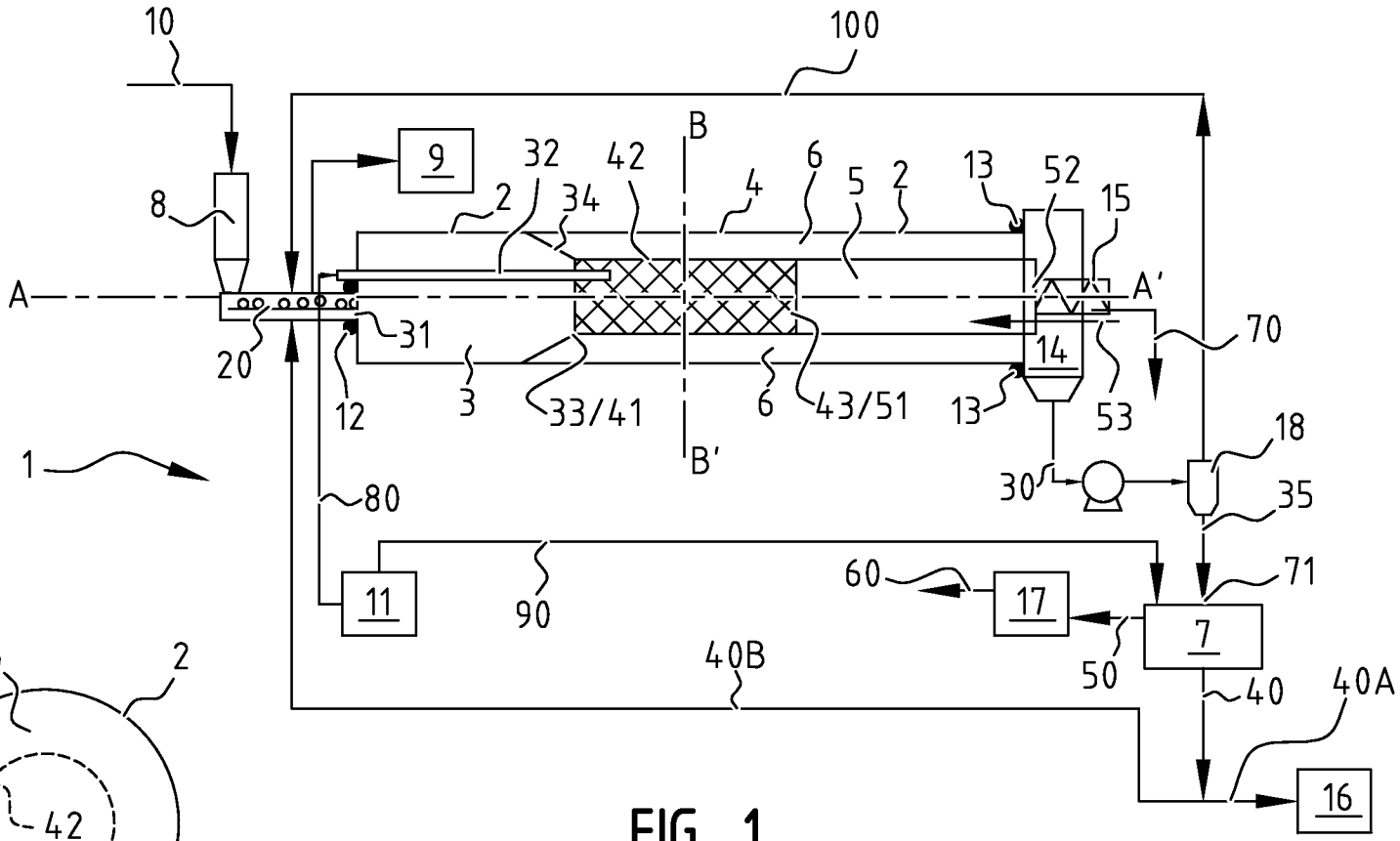
FIG. 1 schematically a first non-limiting embodiment of an apparatus in accordance with the present invention.

FIG. 1 schematically shows a simplified apparatus according to the present invention for removing rejects from an oil sand stream, from which subsequently bitumen is to be extracted. The apparatus is generally referred to with reference numeral 1. The apparatus 1 comprises a housing 2 with a first (mixing) section 3, a second (screening) section 4 and a third (drying/solvent removal) section 5 contained therein. Further shown is a filtration unit 7, a deoxygenator 8, a VRU (vapour recovery unit) 9, a solvent source 11, rotating seals 12 and 13, a pumpbox 14, a conveyor belt 15, a clarifier 16, a drier 17 and a hydrocyclone 18.

The first section 3 has a first (axial) inlet 31 for oil sand, a second inlet 32 for solvent (which may feed into both the first section 3 and the second section 4) and an (axial) outlet 33 for solvent-diluted oil sand slurry. Also, the first section 3 has tapering baffles 34 for guiding the solvent-diluted oil sand slurry towards the (axial) outlet 33/inlet 41.

The second section 4 has an (axial) inlet 41 for the solvent-diluted oil sand slurry (which corresponds to the outlet 33 of the first section 3), a screen 42 allowing undersized material to pass and an (axial) outlet 43 for oversized material.

The third section 5 has an (axial) inlet 51 for oversized material (which corresponds to the outlet 43 of the second section 4), and an (axial) outlet 52 for solvent-depleted oversized material. Also, the third section 3 has an inlet 53 for a purge gas, such as $N_2$ or steam.

In the embodiment of FIG. 1, the screen 42 of the second section 4 and the housing 2 (which in the embodiment of FIG. 1 coincides with the outer wall of the second section 4) define an annular pathway 6 arranged around the screen 42 (and third section 5) for removing the undersized material passed through the screen 42. The annular pathway 6 is fluidly connected to the inlet 71 of the filtration unit 7, via the pumpbox 14 and the hydrocyclone 18.

The first section 3, the second section 4 and the third section 5 can co-rotate during use as one single rotation assembly around the common rotation axis A-A'. Typically, the axis A-A' is at a slight angle (up to 3°) with the ground to assist the (slightly downwards) flow from the first section 3 into the second section 4 and then into the third section 5. For the sake of simplicity no driver has been shown for achieving the rotation of the first section 3, the second section 4 and the third section 5; the person skilled in the art will readily understand that this driver is not limited in any way.

As shown in the embodiment of FIG. 1, the housing 2 is preceded by a deoxygenation unit 8.

The first inlet 31 of the first section 3 for oil sand also functions as an outlet for solvent vapour and is connected to an inlet of a solvent recovery unit 9.

During use of the apparatus 1 as embodied in FIG. 1, a crushed oil sand stream 10 is sent to a de-oxygenation unit 8 to remove oxygen. Subsequently, the deoxygenated oil sand is passed as stream 20 to and fed into the first (mixing) section 3 for contacting the oil sand stream with a solvent such as pentane thereby obtaining a solvent-diluted oil sand slurry. The solvent may be obtained as stream 80 from solvent source 11 (fed via inlet 32), and/or recycled from a point downstream in the process (e.g. stream 100; although in FIG. 1, stream 100 is fed just upstream of the first section 3). The solvent-diluted oil sand slurry is screened in the second (screening) section 4 using the screen 42, thereby obtaining oversized material and undersized material. The oversized material is passed to the third section 5 to remove solvent thereby obtaining solvent-depleted oversized material (or "rejects") 70 which is removed via e.g. a conveyor belt 15 (alternatively, lifters or the like may be used instead of a conveyor belt). The rejects 70 can be used e.g. for land reclamation or simply disposed. The undersized material flows through the annular pathway 6 defined by the screen 42 and the housing 2 to the pumpbox 14. Then, it is pumped as stream 30 to hydrocyclone 18 for thickening. The thickened undersized material is subsequently sent as stream 35 to the inlet 71 of the filtration unit 7 and filtered thereby obtaining a solids-depleted stream 40 and a solids-enriched stream 50 (if desired, using solvent stream 90 from the solvent source 11). Solvent is removed from the solids-enriched stream 50 in drier 17 thereby obtaining a dried solids-enriched stream 60 which is often referred to as "tailings". The solids-depleted stream 40 is relatively bitumen-rich and is further processed (as stream 40A) to recover the bitumen which may be further upgraded in a refinery (not shown) or the like; usually, the solids-depleted stream 40A is first sent to a clarifier 16. As shown in FIG. 1 part 40B of the solids-depleted stream 40 may be reused in the process, e.g. as solvent to be used for the contacting in the first (mixing) section 3. Also, solids-depleted stream 100 recovered from stream 30 in hydrocyclone 18 may be combined with the deoxygenated oil sand stream 20.

Figure 2:
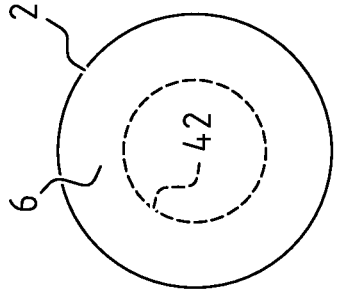
FIG. 2 a cross-section through the apparatus of FIG. 1 at line B-B' to illustrate the annular pathway 6.

FIG. 2 shows a cross-section through the apparatus of FIG. 1 at line B-B' to further illustrate the annular pathway 6 defined by the screen 42 and the housing 2 (coinciding with the outer wall of the second section 4).

Figure 3:
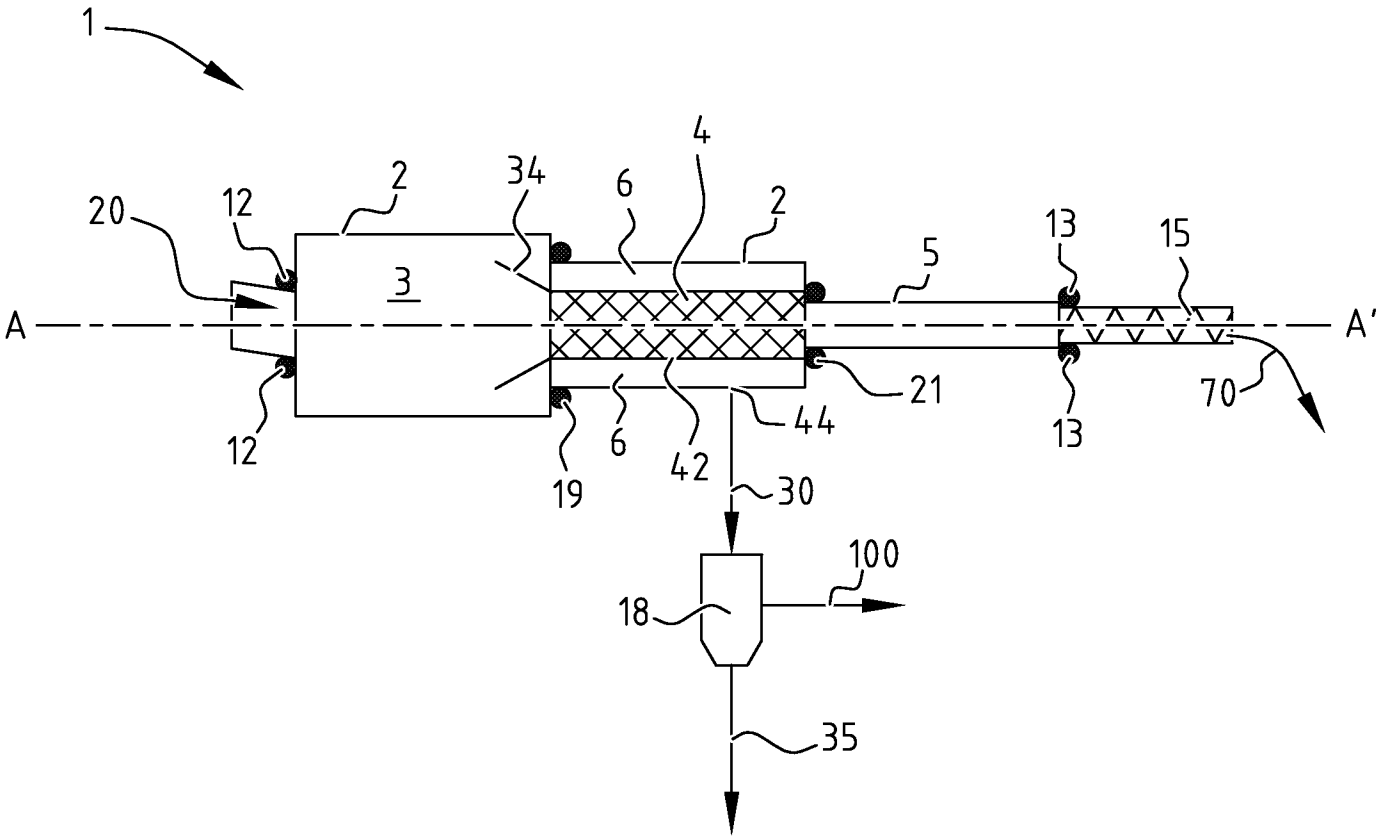
FIG. 3 schematically a part of a second non-limiting embodiment of an apparatus in accordance with the present invention.

FIG. 3 schematically shows a part of a second non-limiting embodiment of an apparatus 1 in accordance with the present invention. Not all lines and components have been shown in FIG. 3, but FIG. 3 serves to show that the annular pathway 6 does not have to surround the third (drying) section 5. The second (screening) section 4 has a second outlet 44 (which may coincide with a pumpbox 14 as shown in FIG. 1) for removing the undersized material that has passed through the screen 42.

Further of note in the embodiment of FIG. 3 is that the second section 4 is defined by the screen 42. Further, that part of the housing 2 that surrounds the second section 4 (and together with the screen 42 defines the annular pathway 6) is static during use and does not rotate around the rotation axis A-A' (but the screen 42 does). To obtain suitable sealing of the apparatus 1 of FIG. 3, rotating seals 19 and 21 are included.

The person skilled in the art will readily understand that many modifications may be made without departing from the scope of the invention.

What is claimed is:

1. A method for extracting bitumen from an oil sand stream the method comprising at least the steps of:

(a) providing an oil sand stream;

(b) contacting the oil sand stream with a solvent in a first section within a rotating housing thereby obtaining a solvent-diluted oil sand slurry;

(c) screening the solvent-diluted oil sand slurry in a second section of the rotating housing, thereby obtaining oversized material retained inside of a screen and undersized material flowing through the screen to an annular pathway between the screen and the housing;

(d) recovering undersized material from the annular pathway;

(e) passing oversized material to a third section of the housing;

(f) removing solvent from the oversized material in the third section within the housing thereby obtaining solvent-depleted oversized material;

(g) filtering the undersized material obtained in step (c), thereby obtaining a solids-depleted stream and a solids-enriched stream; and (h) removing solvent from the solids-depleted stream obtained in step (g) thereby obtaining a bitumen-enriched stream;

wherein the first section, the second section and the third section rotate around a common rotation axis (A-A').

2. The method according to claim 1, wherein the solvent in step (b) comprises a non-aqueous solvent.

3. The method according to claim 1, wherein during the removing of step (f) a purge gas to removes at least some solvent from the oversized material.

4. The method of claim 3 wherein the purge gas is $N_2$.

5. The method of claim 3 wherein the purge gas is steam.

6. The method of claim 3 wherein the purge gas comprises $N_2$.

7. The method of claim 6 wherein the purge gas flows counter current to the flow of oversized material.

8. The method of claim 3 wherein the purge gas comprises steam.

9. The method of claim 8 wherein the purge gas flows counter current to the flow of oversized material.

* * * * *